US006560165B1

(12) United States Patent
Barker

(10) Patent No.: US 6,560,165 B1
(45) Date of Patent: May 6, 2003

(54) MEDICAL INFORMATION APPLIANCE

(76) Inventor: Diane K. Barker, Box 4607, Ketchum, ID (US) 83340

( * ) Notice: Subject to any disclaimer, the term of this patent is extended or adjusted under 35 U.S.C. 154(b) by 0 days.

(21) Appl. No.: 09/537,579

(22) Filed: Mar. 28, 2000

(51) Int. Cl.[7] ..... G04B 47/00

(52) U.S. Cl. ..... 368/10; 368/82; 368/70; 368/239

(58) Field of Search ..... 368/10, 223, 248, 368/263, 281, 82, 239, 107–109, 70, 187, 188; 128/690, 706

(56) References Cited

U.S. PATENT DOCUMENTS

| | | | | | |
|---|---|---|---|---|---|
| 4,063,410 | A | | 12/1977 | Welling | |
| 4,258,354 | A | * | 3/1981 | Carmon et al. | 368/10 |
| 4,293,845 | A | * | 10/1981 | Villa-Real | 368/10 |
| 4,354,260 | A | | 10/1982 | Planzo | |
| 4,626,105 | A | * | 12/1986 | Miller | 368/10 |
| 4,731,765 | A | * | 3/1988 | Cole et al. | 368/10 |
| 4,905,213 | A | * | 2/1990 | Masse et al. | 368/10 |
| 5,012,229 | A | | 4/1991 | Lennon et al. | |
| 5,088,056 | A | * | 2/1992 | McIntosh et al. | 368/10 |
| 5,157,640 | A | * | 10/1992 | Backner | 368/10 |
| 5,337,290 | A | | 8/1994 | Ventimiglia et al. | |
| 5,355,352 | A | * | 10/1994 | Kobayashi et al. | 368/281 |
| 5,408,443 | A | * | 4/1995 | Weinberger | 368/10 |
| 5,477,508 | A | * | 12/1995 | Will | 368/281 |
| 5,495,961 | A | * | 3/1996 | Maestre | 368/10 |
| 5,602,802 | A | * | 2/1997 | Leigh-Spencer et al. | 368/10 |
| 5,649,381 | A | * | 7/1997 | Studer | 368/10 |
| 5,706,257 | A | | 1/1998 | Rothman et al. | |
| 5,719,780 | A | | 2/1998 | Holmes et al. | |
| 5,802,014 | A | * | 9/1998 | Danko | 368/10 |
| 5,825,353 | A | * | 10/1998 | Will | 368/10 |
| 5,872,505 | A | | 2/1999 | Wicks et al. | |
| 6,018,289 | A | * | 1/2000 | Sekura et al. | 368/10 |
| 6,075,755 | A | * | 6/2000 | Zarchan | 368/10 |
| 6,198,383 | B1 | * | 3/2001 | Sekura et al. | 368/10 |
| 6,198,695 | B1 | * | 3/2001 | Kirton et al. | 368/10 |
| 6,255,951 | B1 | * | 7/2001 | De La Huerga | 368/10 |
| 6,335,907 | B1 | * | 1/2002 | Momich et al. | 368/10 |

OTHER PUBLICATIONS e–pill McDose Vibrating Wrist Watch, e–pill.com Web Page printout, dated Mar. 3, 2000.

RemindRx System, Remindrx.com Web Page, dated Mar. 3, 2000.

e–pill Med–Time Automatic Mecdication Dispenser & Reminder, e–pill.com Web Page printout, dated Mar. 3, 2000.

e–pill Health Watch 100 Medical Reminder Watch, e–pill.com Web Page printout, dated Mar. 3, 2000.

e–pill MEDTimer, e–pill.com Web Page printout, dated Mar. 3, 2000.

* cited by examiner

*Primary Examiner*—Vit Miska
*Assistant Examiner*—Jeanne-Marguerite Goodwin
(74) *Attorney, Agent, or Firm*—Robert L. Shaver; Frank J. Dykas; Stephen M. Nipper

(57) ABSTRACT

A medical information appliance which reminds a user of times to take medications or to perform medical-related activities. It features a delay mode, which shuts the alarm off but later reminds the user to take the indicated medication. Multiple alarms can be set for a variety of medications or other medical events, and multiple delay modes will be activated, so that the user is reminded to take medications which have been indicated by an alarm, but taking the medication was not confirmed by the user. The device also features a readout button for displaying stored medical information, for use by medical technicians in the field without connection to further equipment.

21 Claims, 8 Drawing Sheets

MEDICAL INFORMATION APPLIANCE

BACKGROUND OF THE INVENTION

1. Field of the Invention

The present invention generally relates to medical related alarm devices, and more particularly to devices for reminding a person to take medication or perform some other medical related activity.

2. Background Information

It is very common for a patient to take one or more medications during the course of a day. It may be important that the patient take a number of medications, and that they be taken at specified times in order to increase their effectiveness, or to eliminate reactions with other medications being taken. In the case of AIDS patients, it is essential that patients take a large number of drugs, at frequent intervals, at very precise times during the day for effective treatment in current medication regimens. The average person may have a hard time remembering to take any particular medication, and will have an even harder time when there are numerous medications and times for taking them. If a patient is distracted, busy, forgetful, or suffering memory deficiencies or attention deficits, it may become impossible for the patient to keep track of his medications and take them on schedule.

Another problem facing many patients is that they may find themselves in a situation where they require emergency medical assistance in their home or away from the hospital, and they may be unable to tell the emergency medical response personnel what medications they are taking, when they last took them, what the history of taking them for the day has been, or other important medical and personal information which the emergency medical response personnel need to know. This could happen if the person simply couldn't keep track of all the medications he had taken that day, it could also happen when a person was incapacitated by a diabetic coma, a stroke, a heart attack, an epileptic seizure, or other situations in which this information would prove important to personnel in the field.

There are numerous devices available which act as timers to remind a patient when to take a medication. These devices come in a variety of forms and with a variety of features, but none of them fully satisfy the needs of the patient. Some devices are in the form of a wristwatch, and medications and the times for taking them are entered in the wristwatch. Like any alarm wristwatch, at the indicated time for taking the medication, an alarm goes off. The patient may read on the watch what medication is to be taken, and he would then turn off the alarm. The prior art devices assume that when the alarm is turned off, the patient has taken the medication. For some of these alarm devices, that is the end of their functionality. Other alarm devices may record information about the patient, his medications, and the schedule for taking them. Sometimes this information is downloadable to a doctor's computer or a pharmacist's computer.

Medical alarm devices with reminders for taking medication can also take the form of containers which store medications, so that the container may be opened when the alarm goes off and the medication either dispensed to patients, or taken by the patient himself.

There are critical features which prior art alarm devices do not provide to the patient. Many bedside alarm clocks offer a feature which allows a user to press a "snooze" button, which turns the alarm off a few minutes, but comes back on again in 10 or 15 minutes to remind the user to get up. The concept of the "snooze" button is useful for a patient being reminded to take medication, because the medication alarm may go off while he is driving, and the patient would not be able to immediately stop and taken the medication. It would be useful for the patient to be able to turn the alarm off but be reminded at a later time to take the indicated medication. If a person has multiple medications to take, and they turn off the alarm for the first medication, and before they can take the first medication a reminder for a second medication comes up, they need to be able to turn the alarm off for the second medication also, and be reminded at a later time to take both the first and the second medication. If the patient is reminded for numerous medications, such as 8 or 10, he needs to be able to turn the alarm off, and also needs to be reminded at a later time to take those 8 or 10 medications.

Another feature which is lacking in prior art reminder devices is the feature of presenting to emergency medical response personnel important medical information about the patient, including the medications taken that day. Some prior art devices store this information, and it may be retrieved by interaction with a computer, such as at the doctor's office, but what is needed is a simple and fool proof display of information in the field to an emergency medical response person.

The information and displays described above present a problem for medical information appliances. Some of the information above can have many characters, such as 20, 30 or 40 characters. Digital display means for a device the size of a watch have a difficult time presenting 30 plus characters in a format which is visible to the user. The solution to this dilemma is using an array of pixels which has the capability of scrolling characters across the display so that a line of numerous characters are readable to the user.

Accordingly, it is an object of the invention to provide a medical information appliance in which medical events such as medications or other medical activities can be recorded, and times can be recorded for each medical event. It is a further object to remind a user when the time for performing a medical event arrives, and to provide a way for him to turn the alarm off but still be reminded to perform the activity at a later time.

It is a further object of the invention to provide the capability of reminding the patient of multiple medical events, allowing the patient to turn the alarm off on those events as they occur, and to be reminded later to perform the multiple medical events which had been earlier reminded.

It is a further object of the invention to provide the medical information appliance with the ability to display medical information and a history of medical events to an emergency rescue person in the field, without the use of supplemental equipment for downloading the information. It is another object of the invention to provide a scrolling display of information in a medical information appliance, so that a string of data can be displayed in a legible form.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

These and other objects are attained by the medical information device of the appliance. The medical information device of the appliance includes a memory means for storing various kinds of information which the user enters. The information the user enters can be medical information or medical events. Medical information includes such things as blood type, doctor's name, patient's name, patient's age, conditions such as allergies or diabetes, and other information which would be useful for an emergency medical technician. Medical events are medical activities which take place at a certain time and for which the patient is reminded. Medical events can include taking medication at certain times, taking a blood pressure at certain times, eating food at certain times, calling the doctor at certain times, or any health related activity which is set to occur at certain times of the day so many times per day. Both medical information and medical events are entered into the medical information appliance by the user, without the need for extraneous devices or connections such as to a computer, a keyboard, or other input devices. In one form of the invention, the means of entering medical information and medical event data is by the use of buttons which are located on the device. The device also includes a timing means which keeps time, and alerts the user when the time for performing a medical event has arrived. A display means is also included, which displays a scrolling line of characters. The medical information device also includes a means for activating the scrolling message of medical information of medical events. The medical events scroll across at a preselected time, and medical information scrolls across the display means when activated. The device also includes a notification means for signaling a medical event. The notification means activates the scrolling of information across the display means and activates an alarm.

The device also includes a reminder mode activation means, for activating a reminder mode. When the reminder mode is activated, typically by pressing a button, the notification means is deactivated. The notification means would typically be an alarm, a buzzer, or a vibration. When the reminder is activated, after a period of time, a reminder alarm sounds. This would typically be a brief alarm sound, which did not continue, but repeated itself at regular intervals of time until the reminder mode was deactivated. When the reminder mode is activated, the medical event associated with that reminder mode is displayed in the display means.

The device also includes a confirmation means, typically a button, which deactivates the reminder mode and which a user activates when the medical event is responded to. This would typically be button which is depressed when the user was able to take the medication indicated by an earlier alarm, and would deactivate the continuing reminder alarm.

The device also contains a readout means, in which medical information and medical events can be displayed by repeated activation of the readout button. The readout means would be most beneficial to rescue personnel or someone who needed access to the medical information. By pressing one button, which would probably be prominently displayed on the device, medical information would be displayed in an approximate order of priority. This medical information would include the patient's name, his blood type, his phone number, an emergency contact person, that person's phone number, the doctor's name and phone number, and any allergies or conditions such as diabetes or epilepsy. Each time the button is depressed, a different block of medical information is displayed in a scrolling display of characters. As the button is continued to be depressed, medical events can also be displayed so that rescue personnel can see what medication the user has taken, what medication was taken that day, and at what times during the day each medication was taken. It is important that this readout is available for use in the field by rescue personnel without the use of additional hardware such as a computer.

The device also includes an alarm mode defeat means, in which all of the alarms for medical events can be turned off, and stay off until the defeat means is deactivated. This would allow a person to stop using the medical information appliance on a daily basis, but continue to use it as a time piece, or to put it in storage, without erasing all of the information on medical events, and without having the alarms for medical events continue when they are not necessary.

The reminder mode would serve to remind the user of more than one medical event which had been scheduled, but which had not been confirmed. If more than one medical event were scheduled, but the user had not confirmed that it had been performed, the reminder mode would continue and show on the display each of the medical events which had been signaled. When the user found time to perform the medical event, he could confirm each medical event which had been previously signaled but not confirmed.

The medical device of the invention can include a display means which is a field of pixels in which characters are formed. These characters would typically scroll from right to left, so that they could be read from left to right by the user. The display means would be two rows of pixel fields, in which the first display row is positioned above the second display row. It would be obvious to one skilled in this art to realize that different configurations of display means could also be utilized, and would fall within the scope of the invention. For instance, more than two rows of pixel fields could be utilized, and other display means beside pixel fields could also be used, if they allowed a scrolling of the characters across the display means.

The medical information appliance of the invention can also record the time when a medical event is confirmed, as indicated by depressing the confirmation button. This recording of confirmation times provides a history of times than medical events were confirmed. This could indicate to the patient, the doctor, or to a rescue person the times of day or the most recent times that a medications were taken by the patient.

The medical information appliance of the invention can take the form of a watch worn by a user. This could be in the form of a wristwatch, a pendant watch, a pocket watch, or other forms of watches. The medical information appliance can also be in the form of a hand held computer, and thus could be a computer program on such a computer. The device could also be supplied with a means of communication of data from the medical information appliance and a computer. This exchange of information could be by an infrared beam, an interfitting memory storage device, a data transfer cable, or any other means of transferring information from one computer to another.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
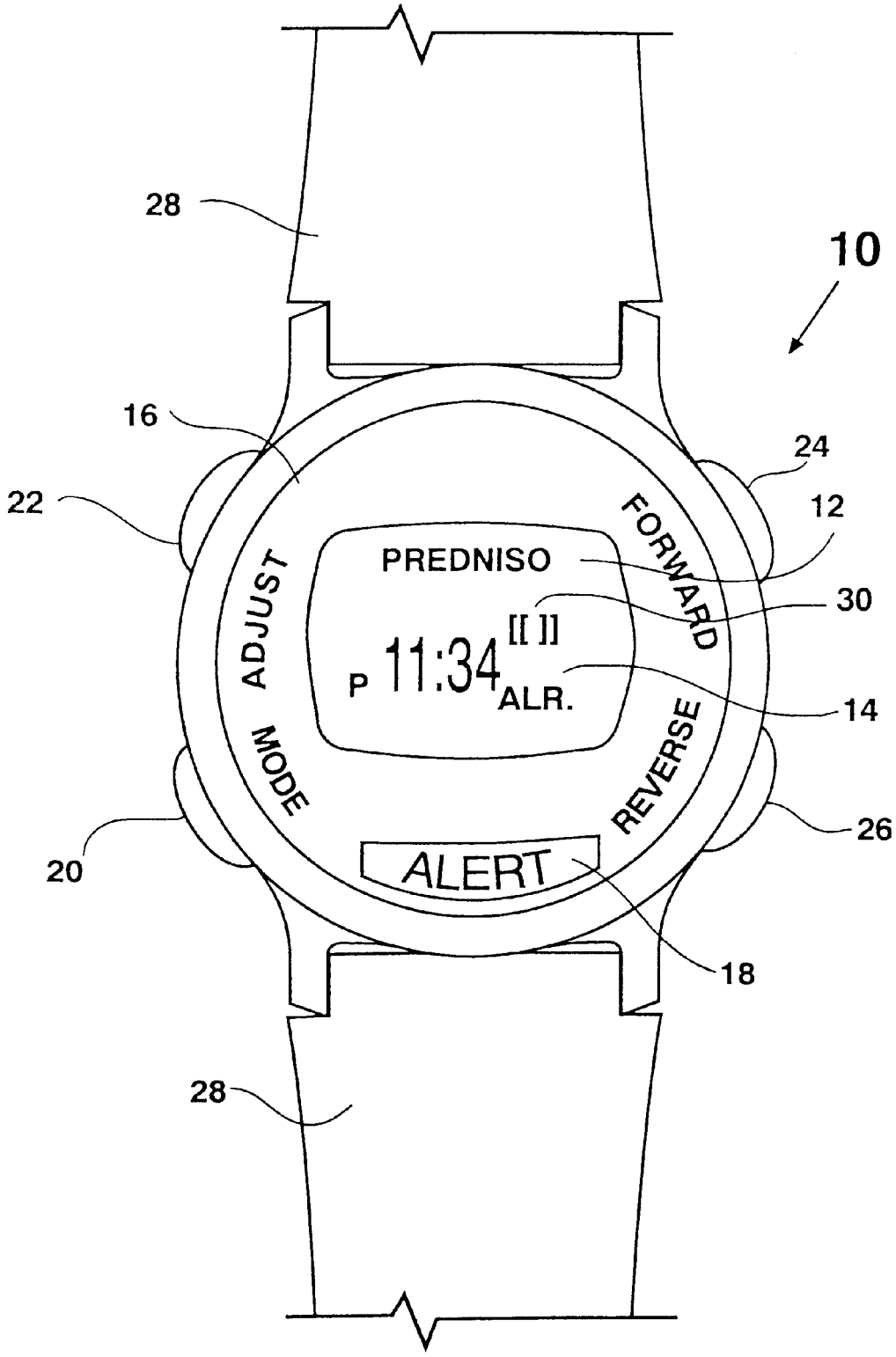
FIG. 1 is a plan view of the alarm mode of the medical information appliance.
Figure 2:
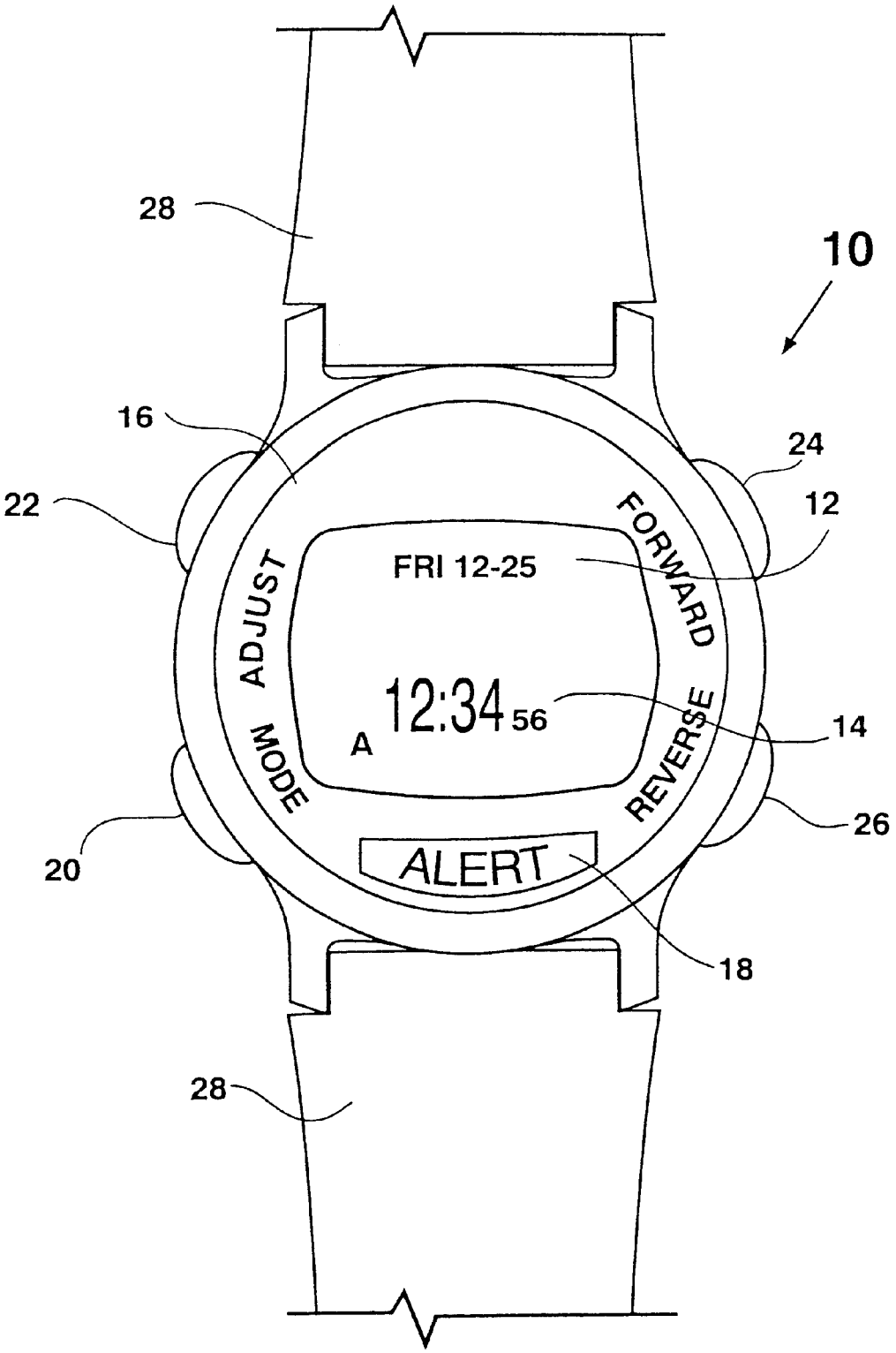
FIG. 2 is a plan view of the time mode of the medical information appliance.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

One preferred embodiment of the invention is shown in FIGS. 1 through 7. In this is preferred embodiment, the medical information appliance is in the form of a wristwatch. The medical information appliance is designated as 10, and includes a first row 12 and a second row 14 of pixel fields. On the watch face 16, an alert button 18 is positioned below the first display row 12 and second display row 14. Located on the side of the watch are four buttons, the mode button 20, the adjust button 22, the forward button 24, and the reverse button 26. The medical information appliance 10 includes a watch strap 28.

FIG. 1 shows one of the four display modes of the medical information appliance 10. The display mode shown in FIG. 1 is the alarm display mode. The device 10 may be changed from one display mode to another by pressing the mode button repeatedly. The other display modes are time, data bank, and activate.

In the preferred embodiment of the medical information appliance 10, twelve daily alarms are available. Into each of these daily alarms, information about twelve medical events could be entered including a description of the event, and the time it is to be activated. In the preferred embodiment, 36 characters may be recorded for a medical event or for medical information. If multiple medications are taken at a given time, the medications can be abbreviated so they all may be listed within 36 characters. Medical events can include reminders to perform certain tests daily or at certain times during the day, to perform certain exercises, to check blood pressure, or to perform any number of medical related activities, and to confirm that the activity has been performed. If a patient normally is away from home during the day, a medical event can be entered which reminds the user to get his medications for the day set up and into his pocket or purse so he will not forget to take them later in the day.

Medical events are entered into the medical information appliance by pressing the mode button 20 until the alarm display is shown. In the preferred embodiment, the words "alarm bank" appears in the display when the alarm display is shown. The forward button 24 or the reverse button 26 are then pressed and cause the device to cycle through the twelve medical events to the one the user would like to enter or change. When one of the twelve medical events is displayed or available for data entry, the adjust button is depressed for two seconds. This will cause the alarm number to begin flashing. Pressing the forward button 24 or the reverse button 26 toggles the alarm indicator 30 on or off. When the alarm indicator is on the screen, it means the alarm is enabled. The absence of this symbol indicates the alarm is disabled. When the information entered into the device is correct, the mode button is pressed to move to the time of each medical event. The forward button 24 and the reverse button 26 are again used to select the minutes. The mode button 20 is again depressed to move to the medication name. The forward button 24 and the reverse button 26 are used to select the first and subsequent letters of the medication name. Pressing and holding the forward or reverse buttons will allow the characters to increment quickly. Pressing the mode button 20 moves to the next character in the medication name. Pressing and holding the mode button will allow the previous characters to be accessed again. These steps can be repeated as many times as is necessary to spell out the medication name. Pressing the adjust button 22 at any time saves the changes or data entered and returns to the alarm bank mode. In the alarm bank mode, the medical event information will scroll across the screen. Pressing the mode button 20 again returns to the time mode, or pressing the forward and reverse buttons can access more of the twelve positions for medical events.

The time mode is selected by pressing the mode button. When in the time mode, if the adjust button 22 is depressed for two seconds, the hour begins flashing. The forward and reverse buttons are used to select the hour, and the mode button excepts the newly entered hour and moves on to the minutes. Forward and reverse is used to adjust the minutes, and the mode button 20 is used to record the minutes and move on to seconds, day of the week, month, and day. Pressing "adjust" at any time excepts the changes that have been made and returns to the time mode.

Figure 3:
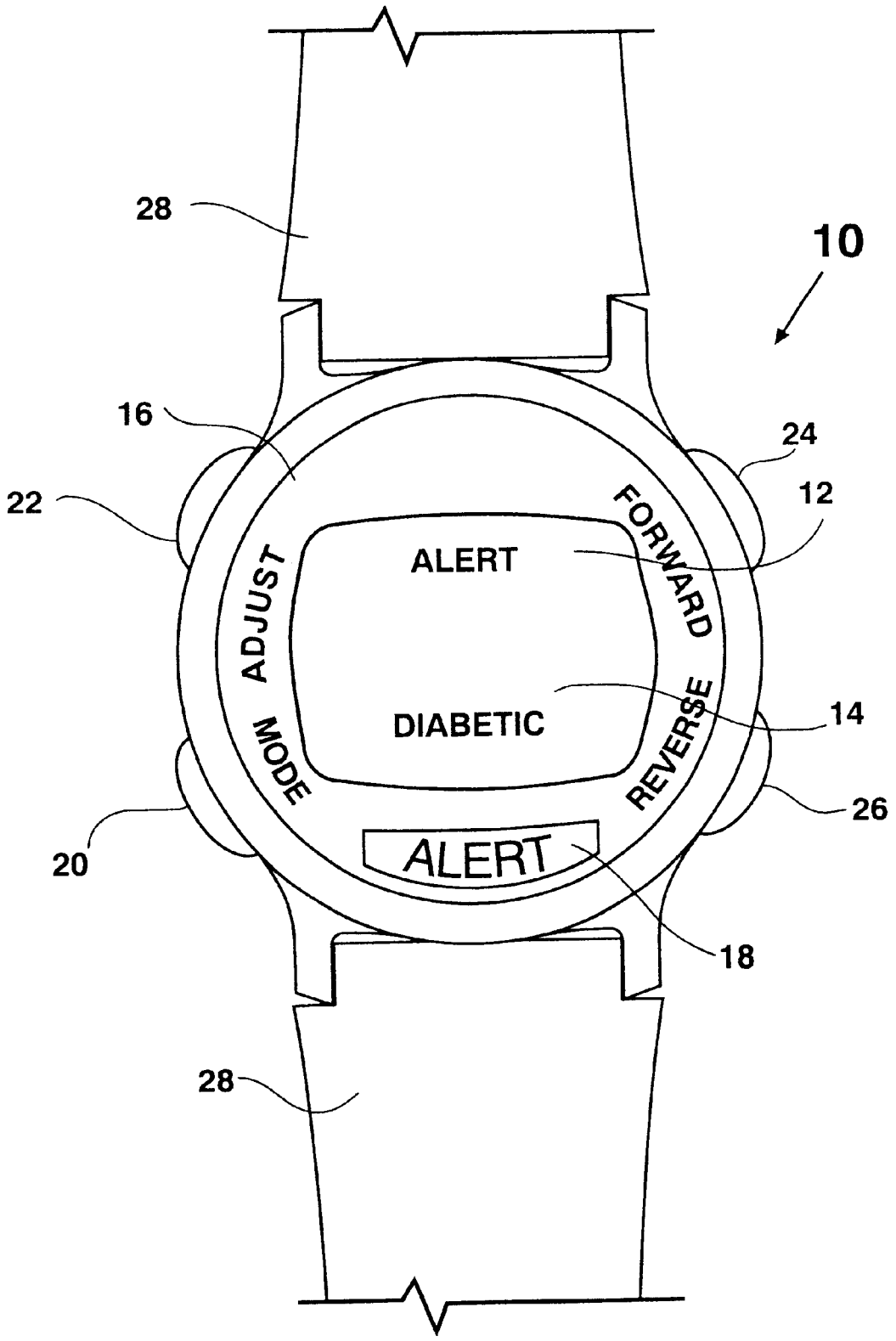
FIG. 3 is a plan view of the data bank mode of the medical information appliance.

FIG. 3 shows the data bank mode of the medical information appliance 10. In the data bank mode, information related to the user is entered and stored. This information can include the name and phone number of the user, alert conditions such as diabetic, pacemaker, hemophiliac, etc., allergic reactions, doctor's name and phone number, emergency contact person and phone number, blood type, date of birth, health insurance company and phone number, health insurance policy number, social security number, and charge card number and expiration date. This information is entered into the medical information appliance 10 in a similar fashion as for the time and alarm information. The mode button is pressed to move into the data bank mode from the time or alarm mode. The forward or reverse buttons are used to select the data which is to be viewed or adjusted. The adjust button opens the data for entry or modification. The forward and reverse buttons then change the character in the first position. The mode button moves on to the next character, and the forward and reverse buttons again are used to select that character. These steps are repeated as many times as are necessary to spell out the data item. Pressing "adjust" at any time can save the changes and return to the data bank mode.

Figure 4:
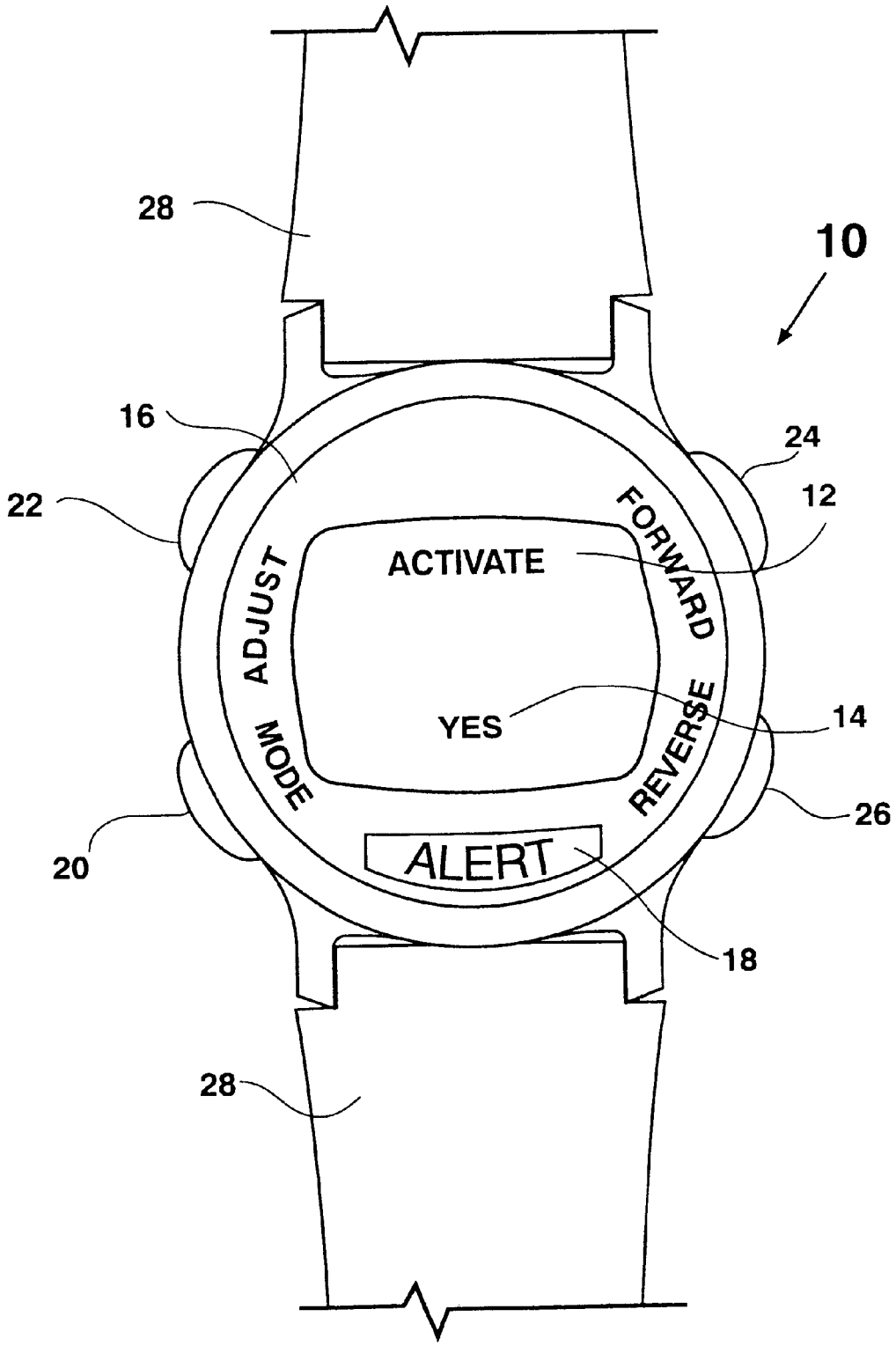
FIG. 4 is a plan view of the activate mode of the medical information appliance.

The fourth mode is shown in FIG. 4. This is the activate mode and contains an electronic master switch which turn all the alarms on or off. This switch can be used to save battery life if the watch is not to be used for an extended length of time. To set the master switch in the activate mode, the mode button is pressed until the watch displays "activate." From that position, the forward or reverse buttons are pressed to toggle between "yes" and "no." The selection of "yes" means all of the individual enabled alarms will function. The selection of "no" means that all the individually enabled alarms will not function, but they will be retained in memory. When the user takes his watch out of storage, he may use the activate mode to activate all of the stored alarms in his watch.

When one of the medications alarms "goes off," the watch will begin to beep continuously for one minute, and the name of the medication will scroll across the face 16 of the watch. This continuous beeping can be turned off by pressing either the forward or reverse buttons. The watch will enter reminder mode. In this mode, the name of the medication will continue to scroll across the face of the watch, and the watch will give two beeps every three minutes. This will subtly remind the patient to take the medications in the event that he is unable to take the medications at the time the alarm first goes off. This reminder mode can be turned off by pressing either the forward or reverse buttons. If the patient only deactivates the reminder mode when he takes his medications or performs the indicated act, then pressing the reminder mode also serves to confirm the taking of medication or performing of the act. In versions of the medical information device which store and record this information for later use, this forms a history of medication use by the patient.

If there are multiple alarms existing in reminder mode, each alarm entry will scroll across the face of the watch with a three second delay between each alarm. An alarm entry may be dumped from the reminder mode by pressing either the forward or reverse buttons while that alarm entry is on the display. Multiple alarms in the reminder mode will cause the watch to do its reminder beep more often than every three minutes.

All of the medical information and medical events stored in the medical information appliance can be displayed by pressing the red alert button 18 on the face 16 of the watch, repeatedly. The only item that will not display is the charge card entry. This is for the user's protection. If the user needs to view this item, he can do it through the data bank setting procedure.

Figure 5:
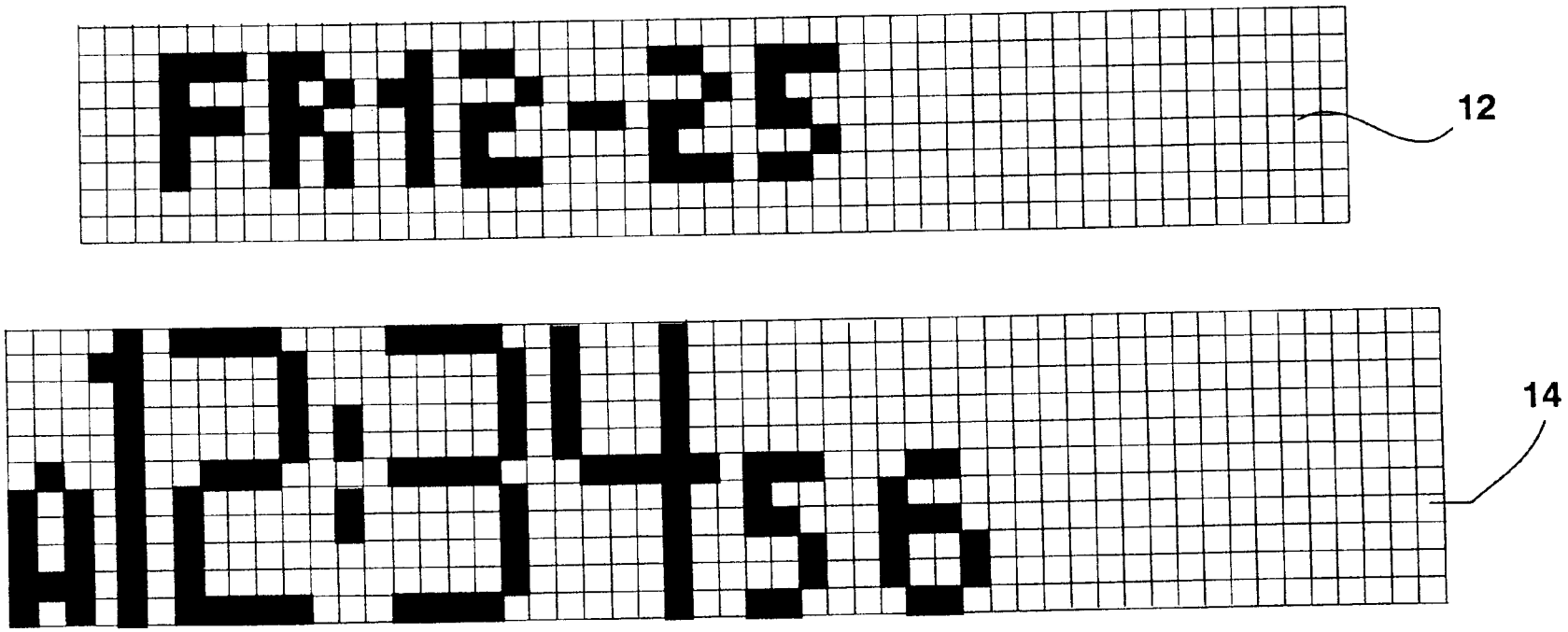
FIG. 5 is a drawing of the first display row and the second display row and the pixels of which they are composed.

FIG. 5 shows the first display row and the second display row, which are made up of a field of pixels, in which the activation of different pixels forms characters. In the preferred embodiment of the invention, the first display row 12 contains fewer pixels than the second display row 14. This allows the second display row 14 to display larger characters, or alternately, to display two rows of characters or different sizes of characters.

Figure 6:
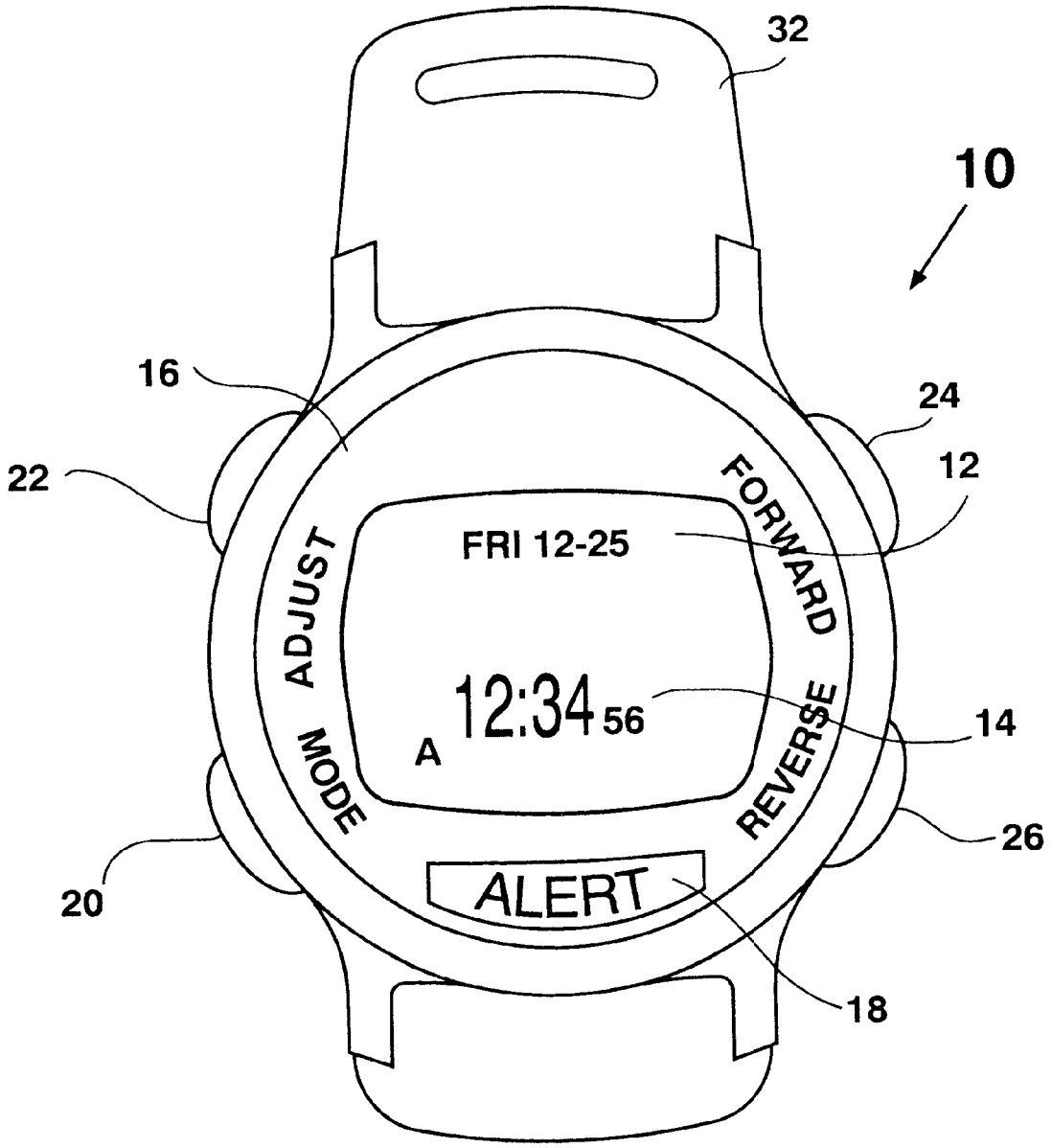
FIG. 6 is a plan view of a pendant watch embodiment of the invention.

FIG. 6 shows an alternative to the preferred embodiment of the invention, in which the medical information appliance is in the form of a pendant watch which is worn around the neck of the user.

Figure 7:
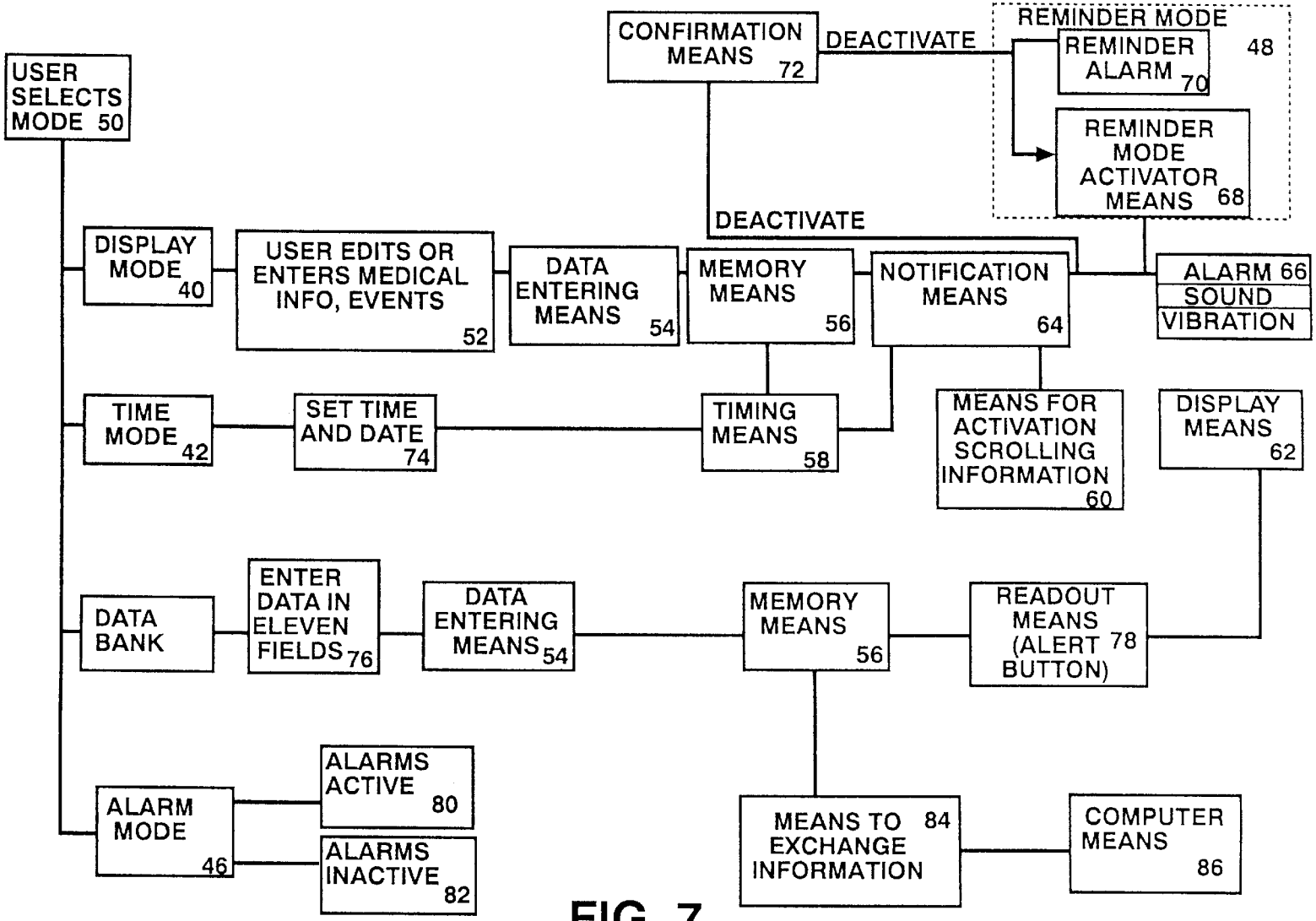
FIG. 7 is a logic diagram of the invention.

FIG. 7 is a diagram showing the logic of the medical information device. The device includes five modes: a display mode at 40, a time mode at 42, a databank mode at 44, an activation mode at 46, and a reminder mode at 48. At block 50, the user selects a mode from among the first four of the modes. If the display mode 40 is chosen, at block 52 the user enters or edits medical information and/or events. This is accomplished through a data entering means 54 which in the preferred embodiment are buttons which are located on the device. Data entered at the data entering means 54 is stored in a memory means 56 of the medical information device 10. This data entering means 54 is self-contained within the device, unlike prior art devices which require a separate computer to enter information. The device also includes a timing means 58 which keeps time, and alerts the user when the time for performing a medical event has arrived. When the time for performing a medical event has arrived, a means of activating the scrolling message is activated at 60, and the scrolling message is displayed on a display means 62, which is typically the LCD screen of a watch like device. The notification means 64 activates the scrolling of information across a display means at 62 and activates an alarm 66. The alarm can be including alarms by sound, or by vibration, as shown in the Figure. The reminder mode 48 can be activated by a reminder mode activation means 68, which typically is a button on the device. When the reminder mode 48 is activated at 68, the alarm 66 is turned off, and after a period of time, the reminder alarm 70 is turned on. A confirmation means 72 is available, which when pressed, deactivates the reminder mode, and which a user activates when the medical event is responded to. This would typically be a button, which is depressed when the user is able to take the medication indicated by an earlier alarm, and would deactivate the recurring reminder alarm. Until the confirmation means 72 is pressed, the reminder alarm periodically activates and may be temporarily turned off by the reminder mode activator means. If the user selects the timing mode 42, the user may set at block 74 the time and date stored in the device in the timing means 58. This timing means is utilized by the display mode 40 in tracking and announcing medical events.

If the user selects databank 44, at block 76, the user may enter data in any or all of the eleven fields of the preferred embodiment. This is accomplished through the use of the data entering means 54, which are the same buttons, which are used in the display mode 40. A readout means 78 is also available which provides instant access to viewing the data in the databank 44. The readout means would typically be an alert button, which is positioned on the face of the device. The readout means 78 displays the information on the display means 62.

The fourth mode of the device is a means for activating or deactivating the alarms of the system, which occur at block 46. If this mode is activated, all of the alarms which are stored in the memory means 56 are activated, and will sound at the appropriate times, at block 80. If the device is deactivated at 46, the information and events continues to be stored, but the alarms are not active, at block 82. Block 84 shows a means of exchange of information between the memory means 56 with its stored data, and a computer means 86.

Figure 8:
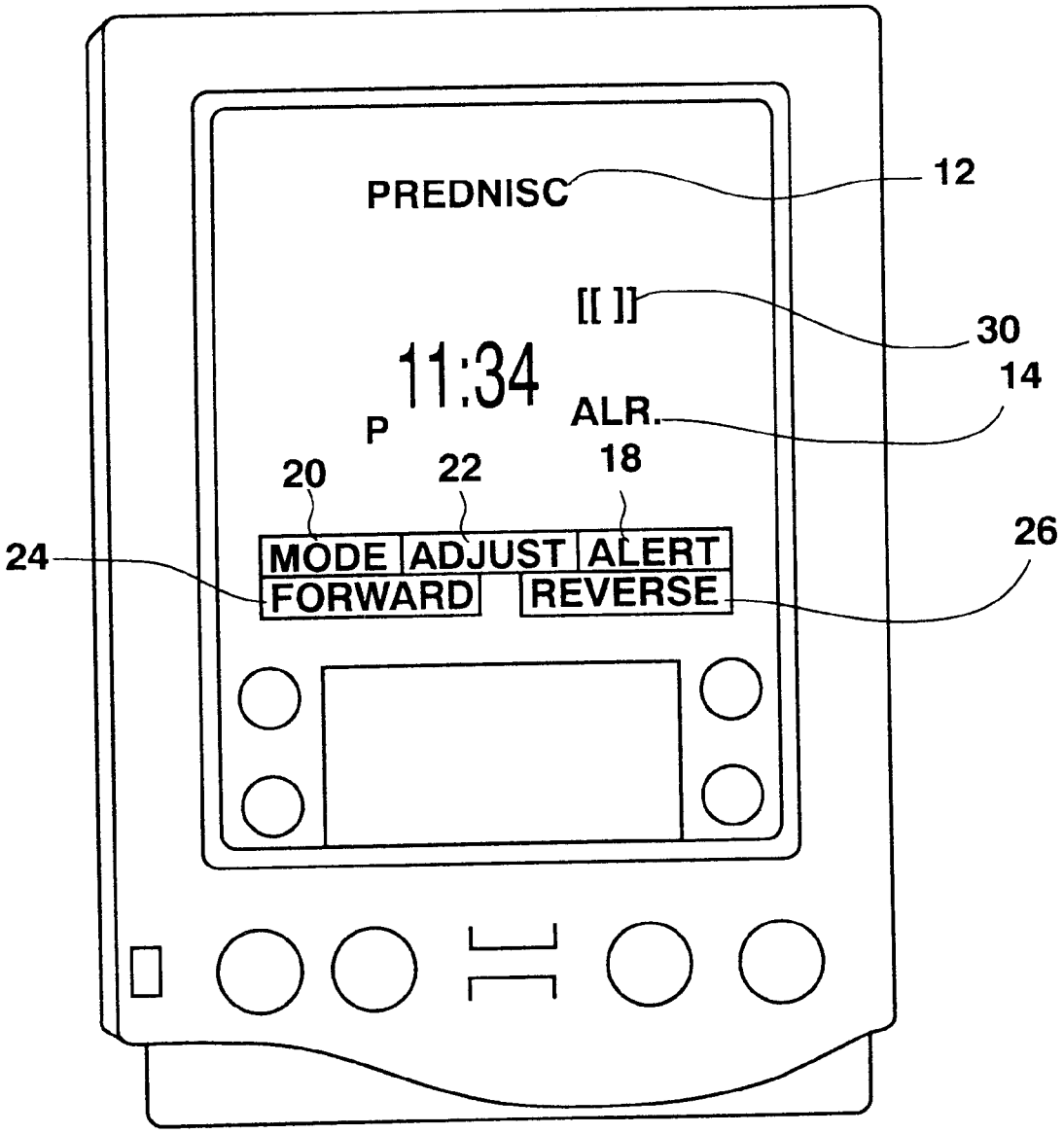
FIG. 8 is a plan view of a hand held computer version of the invention.

FIG. 8 shows an alternative to the preferred embodiment of the invention, in which the device is configured as a hand held computer, and the buttons of the wristwatch configuration are replaced by buttons or menu selections on the hand held computer.

I claim:

1. A medical information appliance, comprising:

a memory means for storing information;

a self contained means of entering a plurality of medical information and medical events into said memory means;

a timing means for keeping time for medical events:

a display means for displaying a scrolling line of characters;

a means for activating an automatically and continuously scrolling message of medical information at a preselected time;

a notification means for signaling a medical event at a preselected time, by scrolling said medical event on said display means, and activating an alarm means;

a reminder mode activation means for activating a reminder mode and deactivating said notification means, in which said reminder mode includes a reminder alarm means which activates at periodic intervals until said reminder mode is deactivated, and in which a medical event is displayed in said display means;

a confirmation button which deactivates said reminder mode and said notification means when activated, and which a user activates when said medical event has been responded to; and a watch face with only a single readout button, which accesses a first unit of stored medical information and displays said first unit of stored medical information upon said display means when said single readout button is depressed once, and in which each subsequent depression of said single readout button results in a display of a subsequent unit of stored medical information, until all units of medical information have been displayed.

2. The device of claim 1 wherein additional depression of said single readout button after all units of medical information have been displayed causes display of said first unit of stored medical information, and a repetition of displayed units of medical information is available.

3. The medical information appliance of claim 1 in which said reminder mode sequentially displays multiple medical events if more than one medical event has occurred without activation of said confirmation button, and which allows the selective deactivation of chosen medical events in said reminder mode by depressing said confirmation button during display of said selected medical event in said reminder mode.

4. The medical information appliance of claim 1 in which said display means is comprised of a pixel field in which characters are formed.

5. The medical information appliance of claim 4 in which said display means is comprised of two rows of pixel fields, with a first display row positioned above a second display row.

6. The medical information appliance of claim 4 in which said display means presents a right to left scrolling of characters.

7. The medical information appliance of claim 1 which further comprises a means of recording a time when said confirmation button is depressed for a history of times medical events were taken confirmed.

8. The medical information appliance of claim 1 in which said medical information appliance is in the form of a watch worn by a user.

9. The medical information appliance of claim 8 in which said medical information appliance is in the form of a wrist watch worn by a user.

10. The medical information appliance of claim 1 in which said medical information appliance is in the form of a hand held computer.

11. The medical information appliance of claim 1 which further comprises a means to exchange information between said medical information appliance with computer means.

12. The medical information appliance of claim 1 in which said alarm means is a sound emitted by said medical information appliance.

13. The medical information appliance of claim 1 in which said alarm means is a vibration emitted by said medical information appliance.

14. The medical information appliance of claim 1 in which said memory means comprises eleven fields for recording medical information, and each field holds 36 characters of information.

15. The medical information appliance of claim 6 in which medical information concerning a medical event scrolls across said first display row when a medical event is indicated, and simultaneously said alarm means is activated.

16. The medical information appliance of claim 14 in which said second display row displays time when a medical event is indicated.

17. The medical information appliance of claim 13 in which said reminder activation means is a button for activating a reminder mode and deactivating said alarm means and for activating a periodic reminder alarm, in which said periodic reminder alarm sounds at periodic intervals until said reminder mode is deactivated.

18. The medical information appliance of claim 6 in which when said readout button is depressed, either of said first or second display rows displays a field title of medical information stored in said memory means, and the corresponding display row displays a scrolling display of said medical information.

19. The medical information appliance of claim 16 in which when said readout button is depressed, said first display row displays a field title of medical information stored in said memory means, and said second display row displays a scrolling display of said medical information.

20. A medical information appliance, comprising:

a watch case with an upper face;

a memory means for storing information;

a self contained means of entering medical information and medical events into said memory means;

a timing means for keeping time for medical events and for display of time information:

a display means for displaying a continuously scrolling line of characters;

a notification means for signaling a medical event at a preselected time, by activating a continuously scrolling message of said medical event on said display means at a preselected time, and activating an alarm means;

a reminder mode activation means for activating a reminder mode and deactivating said notification means, in which said reminder mode includes a reminder alarm means which activates at periodic intervals until said reminder mode is deactivated, and in which a medical event is displayed in said display means, and in which said reminder mode sequentially displays multiple medical events if more than one medical event has occurred without activation of said confirmation button, and which allows the selective deactivation of chosen medical events in said reminder mode by depressing said confirmation button during display of said selected medical event in said reminder mode;

a confirmation button which deactivates said reminder mode and said notification means when activated, and which a user activates when said medical event has been responded to;

a readout button on said upper face for sequential readout of medical information and medical events by repeated activation of said readout button for use by rescue personnel;

an alarm mode defeat means for deactivating all of said alarms for said medical events, while leaving said medical events in said memory means.

21. A hand held computer based medical information appliance for use with a hand held computer with a display window, data entry means, memory means, and operating system, said medical information appliance comprising:

a self contained means of entering medical information and medical events into said memory means;

a timing means for keeping time for medical events and for display of time information:

a notification means for signaling a medical event at a preselected time, by activating a message of said medical event on said display means at a preselected time, and activating an alarm means;

a reminder mode activation means for activating a reminder mode and deactivating said notification means in which said reminder mode includes a reminder alarm means, which activates at periodic intervals until said reminder mode is deactivated, and in which a medical event is displayed in said display means, and in which said reminder mode sequentially displays multiple medical events if more than one medical event has occurred without activation of said confirmation button, and which allows the selective deactivation of chosen medical events in said reminder mode by depressing said confirmation button during display of said selected medical event in said reminder mode;

a confirmation means which deactivates said reminder mode when activated, and which a user activates when said medical event is responded to;

a readout button on said upper face for sequential readout of medical information and medical events by repeated activation of said readout button for use by rescue personnel; and an alarm mode defeat means for deactivating all of said alarms for said medical events, while leaving said medical events in said memory means.

* * * * *